US012181194B2

(12) United States Patent
Taras et al.

(10) Patent No.: US 12,181,194 B2
(45) **Date of Patent: *Dec. 31, 2024**

(54) HEAT PUMP AND WATER HEATER

(71) Applicant: Climate Master, Inc., Oklahoma City, OK (US)

(72) Inventors: Michael F. Taras, Oklahoma City, OK (US); Michael S. Privett, Tuttle, OK (US); Jeremy R. Smith, Edmond, OK (US)

(73) Assignee: Climate Master, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/821,020

(22) Filed: Aug. 19, 2022

(65) Prior Publication Data

US 2022/0390148 A1 Dec. 8, 2022

Related U.S. Application Data

(63) Continuation of application No. 17/129,558, filed on Dec. 21, 2020, now Pat. No. 11,448,430, which is a (Continued)

(51) Int. Cl.
*F25B 30/02* (2006.01)
*F25B 6/04* (2006.01)

(Continued)

(52) U.S. Cl.
CPC ..... *F25B 6/04* (2013.01); *F25B 13/00* (2013.01); *F25B 30/02* (2013.01); *F25B 41/20* (2021.01);

(Continued)

(58) Field of Classification Search
CPC .. F25B 30/02; F25B 6/04; F25B 13/00; F25B 2339/047; F25B 2400/0403; F25B 2400/0409; F25B 2600/2501
See application file for complete search history.

(56) References Cited

U.S. PATENT DOCUMENTS 1,723,649 A 8/1929 Heath
3,354,774 A 11/1967 Smitzer et al.

(Continued)

FOREIGN PATENT DOCUMENTS

AU 2013200092 4/2013
CA 1178268 11/1984

(Continued)

OTHER PUBLICATIONS

"134-XS and 134-S Series Compressors ECOnomizer (EA-12-03-E)," 134-XS and 134-S series—Application and Maintenance Manual, Technical report EA1203E, RefComp Refrigerant Compressors, undated but believed to be publicly available at least as early as Mar. 2014 (4 pages).

(Continued)

*Primary Examiner* — Lionel Nouketcha
(74) *Attorney, Agent, or Firm* — Crowell & Moring LLP; Thomas E. Williams

(57) ABSTRACT

An embodiment of the instant disclosure comprises a reversible heat pump and water heating system for conditioning a space and heating water. The system comprises a refrigerant circuit that includes a compressor, a source heat exchanger, a space heat exchanger, and an expansion device. A 4-way reversing valve alternates between heating and cooling modes of operation. The system includes a heat exchanger for heating water in the water heating loop, and a 3-way valve that either actuates the refrigerant flow through the water heater heat exchanger or bypasses at least a portion of the refrigerant flow around the water heater heat exchanger. The heat pump system is operable in at least five modes—space heating only, space cooling only, water heating only, and either space heating or space cooling combined with water heating. Use of a modulating 3-way valve allows the amount of the refrigerant flow through the water heating (Continued)

heat exchanger to be adjusted to precisely match space conditioning and water heating demands and stable operation of the heat pump system. Either of the space and source heat exchangers may be bypassed and deactivated to reduce the heat pump system power consumption.

19 Claims, 7 Drawing Sheets

Related U.S. Application Data continuation of application No. 15/634,434, filed on Jun. 27, 2017, now Pat. No. 10,871,314.

(60) Provisional application No. 62/359,798, filed on Jul. 8, 2016.

(51) Int. Cl.
*F25B 13/00* (2006.01)
*F25B 41/20* (2021.01)

(52) U.S. Cl.
CPC ..... *F25B 2313/02321* (2013.01); *F25B 2313/0233* (2013.01); *F25B 2339/047* (2013.01); *F25B 2400/0403* (2013.01); *F25B 2600/2501* (2013.01)

(56) References Cited

U.S. PATENT DOCUMENTS 3,460,353 A 8/1969 Ogata et al.
3,916,638 A 11/1975 Schmidt
3,938,352 A 2/1976 Schmidt
4,072,187 A 2/1978 Lodge
4,091,636 A 5/1978 Margen
4,173,865 A 11/1979 Sawyer
4,179,894 A 12/1979 Hughes
4,257,239 A 3/1981 Partin et al.
4,299,098 A 11/1981 Derosier
4,399,664 A 8/1983 Derosier
4,441,901 A 4/1984 Endoh
4,476,920 A 10/1984 Drucker et al.
4,493,193 A 1/1985 Fisher
4,528,822 A 7/1985 Glamm
4,538,418 A 9/1985 Lawrence et al.
4,575,001 A 3/1986 Oskarsson et al.
4,584,844 A 4/1986 Lemal
4,592,206 A 6/1986 Yamazaki et al.
4,598,557 A 7/1986 Robinson et al.
4,645,908 A 2/1987 Jones
4,646,537 A 3/1987 Crawford
4,646,538 A 3/1987 Blackshaw et al.
4,685,307 A 8/1987 Jones
4,693,089 A 9/1987 Bourne et al.
4,698,978 A 10/1987 Jones
4,727,727 A 3/1988 Reedy
4,766,734 A 8/1988 Dudley
4,776,180 A 10/1988 Patton et al.
4,796,437 A 1/1989 James
4,798,059 A 1/1989 Morita
4,798,240 A 1/1989 Gerstmann et al.
4,799,363 A 1/1989 Nakamura
4,835,976 A 6/1989 Torrence
4,856,578 A 8/1989 Mccahill
4,893,476 A 1/1990 Bos et al.
4,909,041 A 3/1990 Jones
4,909,312 A 3/1990 Biedenbach et al.
4,920,757 A 5/1990 Gazes et al.
4,924,681 A 5/1990 Devit et al.
4,938,032 A 7/1990 Mudford
5,038,580 A 8/1991 Hart
5,044,425 A 9/1991 Tatsumi et al.
5,081,848 A 1/1992 Rawlings et al.
5,088,296 A 2/1992 Hamaoka
5,099,651 A 3/1992 Fischer
5,105,629 A 4/1992 Parris et al.
5,136,855 A 8/1992 Lenarduzzi
5,172,564 A 12/1992 Reedy
5,187,944 A 2/1993 Jarosch
5,224,357 A 7/1993 Galiyano et al.
5,239,838 A 8/1993 Tressler
5,269,153 A 12/1993 Cawley
5,305,822 A 4/1994 Kogetsu et al.
5,309,732 A 5/1994 Sami
5,323,844 A 6/1994 Sumitani et al.
5,339,890 A 8/1994 Rawlings
5,355,688 A 10/1994 Rafalovich et al.
5,372,016 A 12/1994 Rawlings
5,438,846 A 8/1995 Datta
5,461,876 A 10/1995 Dressier
5,463,619 A 10/1995 van Steenbrugge et al.
5,465,588 A 11/1995 Mccahill et al.
5,477,914 A 12/1995 Rawlings
5,497,629 A 3/1996 Rafalovich et al.
5,507,337 A 4/1996 Rafalovich et al.
5,533,355 A 7/1996 Rawlings
5,564,282 A 10/1996 Kaye
5,613,372 A 3/1997 Beal et al.
5,619,864 A 4/1997 Reedy
5,622,057 A 4/1997 Bussjager et al.
5,628,200 A 5/1997 Pendergrass
5,651,265 A 7/1997 Grenier
5,669,224 A 9/1997 Lenarduzzi
5,689,966 A 11/1997 Zess et al.
5,706,888 A 1/1998 Ambs et al.
5,729,985 A 3/1998 Yoshihara et al.
5,758,514 A 6/1998 Genung et al.
5,802,864 A 9/1998 Yarbrough et al.
5,927,088 A 7/1999 Shaw
5,937,665 A 8/1999 Kiessel
5,953,926 A 9/1999 Dressler et al.
5,983,660 A 11/1999 Kiessel et al.
6,000,154 A 12/1999 Berard et al.
6,016,629 A 1/2000 Sylvester et al.
6,032,472 A 3/2000 Heinrichs et al.
6,070,423 A 6/2000 Hebert
6,082,125 A 7/2000 Savtchenko
6,123,147 A 9/2000 Pittman
6,149,066 A 11/2000 Perry et al.
6,167,715 B1 1/2001 Hebert
6,212,892 B1 4/2001 Rafalovich
6,227,003 B1 5/2001 Smolinsky
6,253,564 B1 7/2001 Yarbrough et al.
6,347,527 B1 2/2002 Bailey et al.
6,385,983 B1 5/2002 Sakki et al.
6,418,745 B1 7/2002 Ratliff
6,434,960 B1 8/2002 Rousseau
6,474,087 B1 11/2002 Lifson
6,536,221 B2 3/2003 James
6,615,602 B2 9/2003 Wilkinson
6,644,047 B2 11/2003 Taira
6,655,164 B2 12/2003 Rogstam
6,662,864 B2 12/2003 Burk et al.
6,668,572 B1 12/2003 Seo et al.
6,694,750 B1 2/2004 Lifson et al.
6,729,151 B1 5/2004 Thompson
6,751,972 B1 6/2004 Jungwirth
6,804,975 B2 10/2004 Park
6,817,205 B1 11/2004 Lifson et al.
6,826,921 B1 12/2004 Uselton
6,857,285 B2 2/2005 Hebert
6,892,553 B1 5/2005 Lifson et al.
6,915,656 B2 7/2005 Ratliff
6,931,879 B1 8/2005 Wiggs
6,938,438 B2 9/2005 Lifson et al.
6,941,770 B1 9/2005 Taras et al.
7,000,423 B2 2/2006 Lifson et al.
7,028,492 B2 4/2006 Taras et al.
7,059,151 B2 6/2006 Taras et al.
7,114,349 B2 10/2006 Lifson et al.
7,150,160 B2 12/2006 Herbert
7,155,922 B2 1/2007 Harmon et al.

(56) References Cited

U.S. PATENT DOCUMENTS

| | | | |
|---|---|---|---|
| 7,185,505 | B2 | 3/2007 | Kamimura |
| RE39,597 | E | 5/2007 | Rousseau |
| 7,210,303 | B2 | 5/2007 | Zhang et al. |
| 7,228,696 | B2 | 6/2007 | Ambs et al. |
| 7,228,707 | B2 | 6/2007 | Lifson et al. |
| 7,234,311 | B2 | 6/2007 | Lifson et al. |
| 7,254,955 | B2 | 8/2007 | Otake et al. |
| 7,263,848 | B2 | 9/2007 | Bhatti |
| 7,272,948 | B2 | 9/2007 | Taras et al. |
| 7,275,384 | B2 | 10/2007 | Taras et al. |
| 7,275,385 | B2 | 10/2007 | Abel et al. |
| 7,290,399 | B2 | 11/2007 | Taras et al. |
| 7,325,414 | B2 | 2/2008 | Taras et al. |
| 7,454,919 | B2 | 11/2008 | Ookoshi et al. |
| 7,484,374 | B2 | 2/2009 | Pham et al. |
| 7,617,697 | B2 | 11/2009 | Mccaughan |
| 7,654,104 | B2 | 2/2010 | Groll et al. |
| 7,716,943 | B2 | 5/2010 | Seefeldt |
| 7,752,855 | B2 | 7/2010 | Matsuoka et al. |
| 7,770,405 | B1 | 8/2010 | Dillon |
| 7,823,404 | B2 | 11/2010 | Hanson |
| 7,845,190 | B2 | 12/2010 | Pearson |
| 7,854,137 | B2 | 12/2010 | Lifson et al. |
| 7,856,834 | B2 | 12/2010 | Haley |
| 7,878,010 | B2 | 2/2011 | Nishimura et al. |
| 7,913,501 | B2 | 3/2011 | Ellis et al. |
| 7,937,960 | B2 | 5/2011 | Matsui |
| 7,946,121 | B2 | 5/2011 | Yamaguchi et al. |
| 7,954,333 | B2 | 6/2011 | Yoshimi |
| 7,958,737 | B2 | 6/2011 | Lifson et al. |
| 7,975,495 | B2 | 7/2011 | Voorhis et al. |
| 7,975,506 | B2 | 7/2011 | James et al. |
| 7,980,086 | B2 | 7/2011 | Kotani et al. |
| 7,980,087 | B2 | 7/2011 | Anderson et al. |
| 7,997,092 | B2 | 8/2011 | Lifson et al. |
| 7,997,093 | B2 | 8/2011 | Kasahara |
| 8,033,123 | B2 | 10/2011 | Kasahara et al. |
| 8,037,713 | B2 | 10/2011 | Haley et al. |
| 8,069,682 | B2 | 12/2011 | Yoshimi et al. |
| 8,074,459 | B2 | 12/2011 | Murakami et al. |
| 8,079,228 | B2 | 12/2011 | Lifson et al. |
| 8,079,229 | B2 | 12/2011 | Lifson et al. |
| 8,082,751 | B2 | 12/2011 | Wiggs |
| 8,136,364 | B2 | 3/2012 | Lifson et al. |
| 8,156,757 | B2 | 4/2012 | Doty et al. |
| 8,191,376 | B2 | 6/2012 | Fox et al. |
| 8,215,121 | B2 | 7/2012 | Yoshimi et al. |
| 8,220,531 | B2 | 7/2012 | Murakami et al. |
| 8,286,438 | B2 | 10/2012 | Mccahill |
| 8,381,538 | B2 | 2/2013 | Lifson et al. |
| 8,397,522 | B2 | 3/2013 | Springer et al. |
| 8,402,779 | B2 | 3/2013 | Nishimura et al. |
| 8,418,482 | B2 | 4/2013 | Bush et al. |
| 8,418,486 | B2 | 4/2013 | Taras et al. |
| 8,424,326 | B2 | 4/2013 | Mitra et al. |
| 8,459,052 | B2 | 6/2013 | Bush et al. |
| 8,528,359 | B2 | 9/2013 | Lifson et al. |
| 8,555,703 | B2 | 10/2013 | Yoshimi et al. |
| 8,561,425 | B2 | 10/2013 | Mitra et al. |
| 8,650,893 | B2 | 2/2014 | Hanson |
| 8,695,404 | B2 | 4/2014 | Kadle et al. |
| 8,701,432 | B1 | 4/2014 | Olson |
| 8,726,682 | B1 | 5/2014 | Olson |
| 8,733,429 | B2 | 5/2014 | Harrison et al. |
| 8,756,943 | B2 | 6/2014 | Chen et al. |
| 8,769,982 | B2 | 7/2014 | Ignatiev et al. |
| 8,910,419 | B1 | 12/2014 | Oberst |
| 8,919,139 | B2 | 12/2014 | Yamada et al. |
| 8,959,950 | B2 | 2/2015 | Doty et al. |
| 8,984,903 | B2 | 3/2015 | Itoh et al. |
| 9,052,125 | B1 | 6/2015 | Dostal |
| 9,297,565 | B2 | 3/2016 | Hung |
| 9,303,908 | B2 | 4/2016 | Kasahara |
| 9,383,026 | B2 | 7/2016 | Eggleston |
| 9,459,032 | B2 | 10/2016 | Nishimura et al. |
| 9,551,514 | B2 | 1/2017 | Tartakovsky |
| 9,562,700 | B2 | 2/2017 | Watanabe |
| 9,599,377 | B2 | 3/2017 | Kato |
| 9,625,195 | B2 | 4/2017 | Hiraki et al. |
| 9,791,195 | B2 | 10/2017 | Okada et al. |
| 9,797,611 | B2 | 10/2017 | Gualt |
| 9,909,785 | B2 | 3/2018 | Kato |
| 9,909,792 | B2 | 3/2018 | Oya |
| 9,920,960 | B2 | 3/2018 | Gerber et al. |
| 10,072,856 | B1 | 9/2018 | Akin et al. |
| 10,118,462 | B2 | 11/2018 | Kohigashi et al. |
| 10,119,738 | B2 | 11/2018 | Hammond et al. |
| 10,126,012 | B2 | 11/2018 | Ikawa et al. |
| 10,132,511 | B2 | 11/2018 | Tartakovsky |
| 10,151,663 | B2 | 12/2018 | Scancarello |
| 10,234,164 | B2 | 3/2019 | Takeuchi et al. |
| 10,345,004 | B1 | 7/2019 | Hern et al. |
| 10,408,484 | B2 | 9/2019 | Honda et al. |
| 10,465,961 | B2 | 11/2019 | Kujak |
| 10,480,807 | B2 | 11/2019 | Goel et al. |
| 10,488,065 | B2 | 11/2019 | Chen et al. |
| 10,488,072 | B2 | 11/2019 | Yajima et al. |
| 10,508,847 | B2 | 12/2019 | Yajima et al. |
| 10,514,176 | B2 | 12/2019 | Weinert |
| 10,527,310 | B2 | 1/2020 | Nagaoka et al. |
| 10,670,282 | B2 | 6/2020 | Yamada et al. |
| 10,677,679 | B2 | 6/2020 | Gupte et al. |
| 10,684,052 | B2 | 6/2020 | Walser et al. |
| 10,731,884 | B2 | 8/2020 | Blanton |
| 10,753,631 | B2 | 8/2020 | Ikawa et al. |
| 10,753,661 | B2 | 8/2020 | Hammond et al. |
| 10,767,882 | B2 | 9/2020 | Kowald et al. |
| 10,816,232 | B2 | 10/2020 | Crawford et al. |
| 10,866,002 | B2 | 12/2020 | Taras et al. |
| 10,866,004 | B2 | 12/2020 | Shiohama et al. |
| 10,871,314 | B2 | 12/2020 | Taras et al. |
| 10,914,482 | B2 | 2/2021 | Yamamoto et al. |
| 10,928,092 | B2 | 2/2021 | Yajima et al. |
| 10,935,260 | B2 | 3/2021 | Taras et al. |
| 10,935,454 | B2 | 3/2021 | Kester |
| 10,941,953 | B2 | 3/2021 | Goel et al. |
| 10,996,131 | B2 | 5/2021 | Mcquade et al. |
| 11,015,828 | B2 | 5/2021 | Sakae et al. |
| 11,015,852 | B2 | 5/2021 | Sakae et al. |
| 11,022,354 | B2 | 6/2021 | Yamada et al. |
| 11,041,647 | B2 | 6/2021 | Weinert |
| 11,041,666 | B2 | 6/2021 | Sakae et al. |
| 11,060,746 | B2 | 7/2021 | Maddox et al. |
| 11,060,775 | B2 | 7/2021 | Delgoshaei |
| 11,079,149 | B2 | 8/2021 | Papas et al. |
| 11,092,566 | B2 | 8/2021 | Chen et al. |
| 11,098,915 | B2 | 8/2021 | Crawford |
| 11,098,937 | B2 | 8/2021 | Uehara et al. |
| 11,125,457 | B1 | 9/2021 | Alfano et al. |
| 11,131,470 | B2 | 9/2021 | Minamida et al. |
| 11,231,197 | B2 | 1/2022 | Mcquade et al. |
| 11,248,816 | B2 | 2/2022 | Ikawa et al. |
| 11,268,718 | B2 | 3/2022 | Minamida et al. |
| 11,274,866 | B2 | 3/2022 | Yamada et al. |
| 11,274,871 | B2 | 3/2022 | Sakae et al. |
| 11,280,523 | B2 | 3/2022 | Sakae et al. |
| 11,287,153 | B2 | 3/2022 | Delgoshaei |
| 11,293,674 | B2 | 4/2022 | Yamada et al. |
| 11,326,798 | B2 | 5/2022 | Green et al. |
| 11,365,897 | B2 | 6/2022 | Blanton |
| 11,408,624 | B2 | 8/2022 | Hovardas et al. |
| 11,415,345 | B2 | 8/2022 | Yajima |
| 11,428,435 | B2 | 8/2022 | Eskew et al. |
| 11,441,803 | B2 | 9/2022 | Goel et al. |
| 11,629,866 | B2 | 4/2023 | Blanton et al. |
| 11,761,666 | B2 | 9/2023 | Atchison et al. |
| 11,933,523 | B2 | 3/2024 | Snider et al. |
| 11,965,672 | B2 | 4/2024 | Locke et al. |
| 2002/0078705 | A1 | 6/2002 | Schlosser et al. |
| 2003/0061822 | A1 | 4/2003 | Rafalovich |
| 2003/0221436 | A1 | 12/2003 | Xu |
| 2003/0221445 | A1 | 12/2003 | Smolinsky |
| 2004/0140082 | A1 | 6/2004 | Hua |
| 2005/0125083 | A1 | 6/2005 | Kiko |

(56) References Cited

U.S. PATENT DOCUMENTS

2006/0010908 A1 1/2006 Taras et al.
2006/0218949 A1 10/2006 Ellis et al.
2006/0225445 A1 10/2006 Lifson et al.
2007/0017243 A1 1/2007 Kidwell et al.
2007/0074536 A1 4/2007 Bai
2007/0146229 A1 6/2007 Lin
2007/0251256 A1 11/2007 Pham et al.
2007/0289319 A1 12/2007 Kim et al.
2007/0295477 A1 12/2007 Mueller et al.
2008/0016895 A1 1/2008 Kim et al.
2008/0041072 A1 2/2008 Seefeldt
2008/0173034 A1 7/2008 Shaw
2008/0196418 A1 8/2008 Lifson et al.
2008/0197206 A1 8/2008 Murakami et al.
2008/0209930 A1 9/2008 Taras et al.
2008/0256975 A1 10/2008 Lifson et al.
2008/0282718 A1 11/2008 Beagle
2008/0286118 A1 11/2008 Gu et al.
2008/0289795 A1 11/2008 Hardin et al.
2008/0296396 A1 12/2008 Corroy et al.
2008/0302113 A1 12/2008 Yin et al.
2008/0302118 A1 12/2008 Chen et al.
2008/0302129 A1 12/2008 Mosemann et al.
2008/0307813 A1 12/2008 Lifson et al.
2008/0309210 A1 12/2008 Luisi et al.
2009/0000611 A1 1/2009 Kaiser
2009/0031739 A1 2/2009 Kasahara et al.
2009/0044550 A1 2/2009 Nishimura et al.
2009/0095000 A1 4/2009 Yoshimi et al.
2009/0100849 A1 4/2009 Nishimura et al.
2009/0107656 A1 4/2009 Marois
2009/0208331 A1 8/2009 Haley et al.
2009/0294097 A1 12/2009 Rini et al.
2009/0314014 A1 12/2009 Ericsson
2009/0314017 A1 12/2009 Nishimura et al.
2010/0005821 A1 1/2010 Mccahill
2010/0005831 A1 1/2010 Vaisman et al.
2010/0024470 A1 2/2010 Lifson et al.
2010/0038052 A1 2/2010 Johnson et al.
2010/0058781 A1 3/2010 Taras et al.
2010/0064710 A1 3/2010 Slaughter
2010/0064722 A1 3/2010 Taras
2010/0077788 A1 4/2010 Lewis
2010/0114384 A1 5/2010 Maxwell
2010/0132399 A1 6/2010 Mitra et al.
2010/0199715 A1 8/2010 Lifson et al.
2010/0251750 A1 10/2010 Lifson et al.
2010/0281894 A1 11/2010 Huff
2010/0287969 A1 11/2010 Ueda et al.
2010/0326100 A1 12/2010 Taras et al.
2011/0023515 A1 2/2011 Kopko et al.
2011/0036119 A1 2/2011 Fujimoto et al.
2011/0041523 A1 2/2011 Taras et al.
2011/0061413 A1 3/2011 Setoguchi
2011/0079032 A1 4/2011 Taras et al.
2011/0088426 A1 4/2011 Lochtefeld
2011/0094248 A1 4/2011 Taras et al.
2011/0094259 A1 4/2011 Lifson et al.
2011/0107780 A1 5/2011 Yamaguchi et al.
2011/0132007 A1 6/2011 Weyna et al.
2011/0174014 A1 7/2011 Scarcella et al.
2011/0192176 A1 8/2011 Kim et al.
2011/0203299 A1 8/2011 Jing et al.
2011/0209490 A1 9/2011 Mijanovic et al.
2011/0259025 A1 10/2011 Noh et al.
2011/0289950 A1 12/2011 Kim et al.
2011/0289952 A1 12/2011 Kim et al.
2012/0011866 A1 1/2012 Scarcella et al.
2012/0067965 A1 3/2012 Rajasekaran et al.
2012/0103005 A1 5/2012 Kopko et al.
2012/0139491 A1 6/2012 Eberhard et al.
2012/0198867 A1 8/2012 Ng et al.
2012/0205077 A1 8/2012 Zinger et al.
2012/0247134 A1 10/2012 Gurin
2012/0291460 A1 11/2012 Aoyagi
2013/0014451 A1 1/2013 Russell et al.
2013/0031934 A1 2/2013 Huff et al.
2013/0092329 A1 4/2013 Eastland
2013/0098085 A1 4/2013 Judge et al.
2013/0104574 A1 5/2013 Dempsey et al.
2013/0160985 A1 6/2013 Chen et al.
2013/0180266 A1 7/2013 Bois
2013/0186116 A1 7/2013 Sami
2013/0269378 A1 10/2013 Wong
2013/0305756 A1 11/2013 Gomes et al.
2014/0013782 A1 1/2014 Kopko et al.
2014/0013788 A1 1/2014 Kopko et al.
2014/0033753 A1 2/2014 Lu et al.
2014/0033755 A1 2/2014 Wong
2014/0053585 A1 2/2014 Huff
2014/0060101 A1 3/2014 Styles et al.
2014/0123689 A1 5/2014 Ellis et al.
2014/0245770 A1 9/2014 Chen et al.
2014/0260392 A1 9/2014 Hawkins et al.
2015/0052937 A1 2/2015 Hung
2015/0059373 A1 3/2015 Maiello et al.
2015/0068740 A1 3/2015 Broder
2015/0204586 A1 7/2015 Burg et al.
2015/0252653 A1 10/2015 Shelton, Jr.
2015/0285539 A1 10/2015 Kopko
2015/0330689 A1 11/2015 Kato et al.
2015/0338139 A1 11/2015 Xu et al.
2016/0076950 A1 3/2016 Jacquet
2016/0238276 A1 8/2016 Andrew et al.
2016/0265819 A1 9/2016 Durrani et al.
2017/0010029 A9 1/2017 Reytblat et al.
2017/0227250 A1 8/2017 Karamanos
2017/0336092 A1 11/2017 Ikawa et al.
2017/0370622 A1 12/2017 Shin et al.
2018/0010829 A1 1/2018 Taras et al.
2018/0128506 A1 5/2018 Taras et al.
2018/0313555 A1 11/2018 Henderson
2018/0328600 A1 11/2018 Swanson
2018/0334794 A1 11/2018 Janabi
2019/0032981 A1 1/2019 Hammond et al.
2019/0170600 A1 6/2019 Tice et al.
2019/0170603 A1 6/2019 Gupte et al.
2019/0178509 A1 6/2019 Taras et al.
2019/0346158 A1 11/2019 Kamada
2019/0351731 A1 11/2019 Jeong
2019/0353361 A1 11/2019 Attari et al.
2020/0041187 A1 2/2020 Huckaby et al.
2020/0072510 A1 3/2020 Brown
2020/0263891 A1 8/2020 Noor et al.
2020/0355411 A1 11/2020 Inoue et al.
2020/0378667 A1 12/2020 Hammond et al.
2021/0018234 A1 1/2021 Lingrey et al.
2021/0041115 A1 2/2021 Yoshioka et al.
2021/0071920 A1 3/2021 Yamada et al.
2021/0095872 A1 4/2021 Taras et al.
2021/0131696 A1 5/2021 She et al.
2021/0131706 A1 5/2021 Yamada et al.
2021/0131709 A1 5/2021 Taras et al.
2021/0180807 A1 6/2021 Taras et al.
2021/0207831 A1 7/2021 Lord et al.
2021/0231330 A1 7/2021 Stephens et al.
2021/0270501 A1 9/2021 Brown et al.
2021/0293418 A1 9/2021 Fuse et al.
2021/0293430 A1 9/2021 Yamada
2021/0293446 A1 9/2021 Fard
2021/0302051 A1 9/2021 Yamada et al.
2021/0318012 A1 10/2021 Yamada et al.
2021/0325081 A1 10/2021 Kagawa et al.
2021/0341170 A1 11/2021 Hikawa et al.
2021/0348820 A1 11/2021 Kobayashi et al.
2021/0356154 A1 11/2021 Kobayashi et al.
2022/0090833 A1 3/2022 Yajima
2022/0099346 A1 3/2022 Alfano et al.
2022/0128277 A1 4/2022 Fukuyama et al.
2022/0186989 A1 6/2022 Yamaguchi et al.
2022/0243939 A1 8/2022 Notaro et al.
2022/0243940 A1 8/2022 Notaro et al.
2022/0243952 A1 8/2022 Kojima
2022/0247846 A1 8/2022 Lim

(56) References Cited

U.S. PATENT DOCUMENTS

| | | | |
|---|---|---|---|
| 2022/0268492 | A1 | 8/2022 | Yajima |
| 2022/0348052 | A1 | 11/2022 | Fox et al. |
| 2022/0380648 | A1 | 12/2022 | Karube et al. |
| 2023/0020557 | A1 | 1/2023 | Kaji et al. |
| 2023/0052745 | A1 | 2/2023 | Kitagawa et al. |
| 2023/0072254 | A1 | 3/2023 | Lamont et al. |
| 2023/0094980 | A1 | 3/2023 | Birnkrant et al. |
| 2023/0097829 | A1 | 3/2023 | Ohkubo et al. |
| 2023/0097844 | A1 | 3/2023 | Birnkrant |
| 2023/0106462 | A1 | 4/2023 | Hovardas et al. |
| 2023/0160587 | A1 | 5/2023 | Delgoshaei et al. |
| 2023/0184618 | A1 | 6/2023 | Gupte et al. |
| 2023/0194137 | A1 | 6/2023 | Fan et al. |
| 2023/0205237 | A1 | 6/2023 | Karamanos et al. |
| 2023/0213252 | A1 | 7/2023 | Mcquade |
| 2023/0213254 | A1 | 7/2023 | Ma |
| 2023/0221025 | A1 | 7/2023 | Nakano et al. |
| 2023/0221026 | A1 | 7/2023 | Blanton |
| 2023/0235907 | A1 | 7/2023 | Dewald et al. |
| 2023/0243534 | A1 | 8/2023 | Song et al. |
| 2023/0243539 | A1 | 8/2023 | Buda |
| 2023/0250981 | A1 | 8/2023 | Notaro et al. |
| 2023/0266026 | A1 | 8/2023 | Notaro et al. |
| 2024/0003584 | A1 | 1/2024 | Willhite et al. |

FOREIGN PATENT DOCUMENTS

| | | | |
|---|---|---|---|
| CN | 1987397 | | 6/2007 |
| CN | 201944952 | | 8/2011 |
| CN | 102353126 | | 2/2012 |
| CN | 203231582 | | 10/2013 |
| CN | 103471275 | | 12/2013 |
| CN | 203396155 | | 1/2014 |
| CN | 203432025 | | 2/2014 |
| CN | 115435444 | A | 12/2022 |
| CN | 115468229 | A | 12/2022 |
| CN | 115493250 | A | 12/2022 |
| CN | 115523604 | A | 12/2022 |
| CN | 115638523 | A | 1/2023 |
| CN | 115711454 | A | 2/2023 |
| CN | 218511135 | U | 2/2023 |
| CN | 115751508 | A | 3/2023 |
| CN | 115751603 | A | 3/2023 |
| CN | 115854484 | A | 3/2023 |
| CN | 115854488 | A | 3/2023 |
| CN | 218672483 | U | 3/2023 |
| CN | 115930357 | A | 4/2023 |
| CN | 115978709 | A | 4/2023 |
| CN | 115978710 | A | 4/2023 |
| CN | 116007066 | A | 4/2023 |
| CN | 116025999 | A | 4/2023 |
| CN | 218915295 | U | 4/2023 |
| CN | 116085938 | A | 5/2023 |
| CN | 116085939 | A | 5/2023 |
| CN | 116123663 | A | 5/2023 |
| CN | 116221902 | A | 6/2023 |
| CN | 116241979 | A | 6/2023 |
| CN | 116242010 | A | 6/2023 |
| CN | 116294062 | A | 6/2023 |
| CN | 116294111 | A | 6/2023 |
| CN | 116336607 | A | 6/2023 |
| CN | 219415010 | U | 7/2023 |
| CN | 116538638 | A | 8/2023 |
| CN | 116558042 | A | 8/2023 |
| CN | 116608539 | A | 8/2023 |
| CN | 219693510 | U | 9/2023 |
| DE | 102007050446.0 | | 4/2009 |
| DE | 202022106612 | U1 | 3/2023 |
| EP | 134015 | | 3/1985 |
| EP | 1736720 | | 12/2006 |
| EP | 1983275 | | 10/2008 |
| EP | 2108897 | B1 | 6/2017 |
| EP | 3358279 | | 6/2020 |
| EP | 3447403 | | 6/2021 |
| EP | 4036486 | | 8/2022 |
| EP | 4180727 | A1 | 5/2023 |
| EP | 4194769 | A1 | 6/2023 |
| ES | 2946857 | A1 | 7/2023 |
| IN | 201917005053 | A | 4/2019 |
| IN | 201917012216 | A | 7/2019 |
| IN | 201917018373 | A | 7/2019 |
| IN | 202117017393 | A | 1/2022 |
| IN | 202117017768 | A | 1/2022 |
| IN | 202117018393 | A | 1/2022 |
| IN | 202118001637 | A | 1/2022 |
| JP | 2000046417 | | 2/2000 |
| JP | 2000274786 | | 10/2000 |
| JP | 2000314563 | | 11/2000 |
| JP | 2001248931 | | 9/2001 |
| JP | 3610812 | | 1/2005 |
| JP | 3744330 | | 12/2005 |
| JP | 2010101515 | | 5/2010 |
| JP | 2010101606 | | 5/2010 |
| JP | 2010133601 | | 6/2010 |
| JP | 2010230181 | | 10/2010 |
| JP | 2015094574 | | 5/2015 |
| JP | 2015175531 | | 10/2015 |
| JP | 2017075760 | | 4/2017 |
| JP | 2020051737 | | 4/2020 |
| JP | 2021103053 | | 7/2021 |
| JP | 2022039608 | | 3/2022 |
| JP | 2022176373 | A | 11/2022 |
| JP | 2023025165 | A | 2/2023 |
| JP | 2023060225 | A | 4/2023 |
| JP | 2023076482 | A | 6/2023 |
| JP | 2023116473 | A | 8/2023 |
| KR | 100963221 | | 6/2010 |
| KR | 20190090972 | | 8/2019 |
| KR | 102551281 | B1 | 7/2023 |
| KR | 102551284 | B1 | 7/2023 |
| KR | 102551286 | B1 | 7/2023 |
| KR | 102569930 | B1 | 8/2023 |
| WO | WO 9600370 | | 1/1996 |
| WO | WO 2001090663 | | 11/2001 |
| WO | WO 2006033782 | | 3/2006 |
| WO | WO 2007007576 | | 1/2007 |
| WO | WO 2008045086 | | 4/2008 |
| WO | WO 2008048252 | | 4/2008 |
| WO | WO 2010004716 | | 1/2010 |
| WO | WO 2010005918 | | 1/2010 |
| WO | WO 2010054498 | | 5/2010 |
| WO | WO 2010104709 | | 9/2010 |
| WO | WO 2013142760 | | 9/2013 |
| WO | WO 2014031559 | | 2/2014 |
| WO | WO 2014031708 | | 2/2014 |
| WO | WO 2016158092 | | 10/2016 |
| WO | WO 2016159152 | | 10/2016 |
| WO | 2017138820 | A1 | 8/2017 |
| WO | 2018135850 | | 7/2018 |
| WO | WO 2020067039 | | 4/2020 |
| WO | WO 2020158653 | | 8/2020 |
| WO | WO 2020179826 | | 9/2020 |
| WO | WO 2021050617 | | 3/2021 |
| WO | WO 2021050618 | | 3/2021 |
| WO | WO 2021050886 | | 3/2021 |
| WO | WO 2021054199 | | 3/2021 |
| WO | WO 2021106957 | | 6/2021 |
| WO | WO 2021125354 | | 6/2021 |
| WO | WO 2021172516 | | 9/2021 |
| WO | WO 2021215528 | | 10/2021 |
| WO | WO 2021234857 | | 11/2021 |
| WO | WO 2022064784 | | 3/2022 |
| WO | 2022168305 | A1 | 8/2022 |
| WO | 2023059724 | A1 | 4/2023 |
| WO | 2023069273 | A1 | 4/2023 |
| WO | 2023084127 | A1 | 5/2023 |
| WO | 2023127329 | A1 | 7/2023 |
| WO | 2023127345 | A1 | 7/2023 |
| WO | 2023140145 | A1 | 7/2023 |
| WO | 2023157565 | A1 | 8/2023 |
| WO | 2023157568 | A1 | 8/2023 |

(56) References Cited

FOREIGN PATENT DOCUMENTS

| | | | |
|---|---|---|---|
| WO | 2023161248 | A1 | 8/2023 |
| WO | 2023161249 | A1 | 8/2023 |

OTHER PUBLICATIONS

"Economized Vapor Injection (EVI) Compressors," Emerson Climate Technologies Application Engineering Bulletin AE4-1327 R2, Revised Sep. 2006 (9 pages).
"Enhanced Vapour Injection (EVI) for ZH*KVE Scroll Compressors," Emerson Climate Technologies—Technical Information, C7.4.3/1107-0512/E, May 2012 (10 pages).
"Heat Pump Mechanics" http://www.geo4va.vt.edU/A3/A3.htm#A3sec3c (Accessed Apr. 20, 2011) (19 pages).
"Heat pumps in residential and commercial buildings" http://www.heatpumpcentre.org/en/aboutheatpumps/heatpumpsinresidential/Sidor/default.aspx (Accessed Apr. 20, 2011) (2 pages).
B.P. Rasmussen et al., "Model-Driven System Identification of Transcritical Vapor Compression Systems," IEEE Transactions on Control Systems Technology, May 2005, pp. 444-451, vol. 13 (8 pages).
Ekaterina Vi Nogradova, "Economizers in Chiller Systems," Bachelor's Thesis, Mikkelin Ammattikorkeakoulu, Nov. 2012 (50 pages).
Haraldsson et al., "Measurement of Performance and Evaluation of a Heat Pump—with Scroll Compressor EVI and Economizer," Lunds Institute of Technology, 2006 (4 pages).
Honeywell, VFF1, VFF2, VFF3, VFF6 Resilient Seat Butterfly Valves with Flanged Connections Jan. 2013, p. 1, 1st col. last paragraph. (Year: 2013) (20 pages).
International Preliminary Report on Patentability issued in International Application No. PCT/US2013/033433 dated Sep. 23, 2014 (7 Pages).
International Search Report and Written Opinion issued in International Application No. PCT/US2013/033433 dated Aug. 9, 2013 (11 Pages).
John P. Elson et al., "Scroll Technology: An Overview of Past, Present and Future Developments," International Compressor Engineering Conference, 2008, Paper 1871 (9 pages).
Korean Intellectual Property Office, International Search Report in International Application No. PCT/US2009/049734 (dated Jan. 20, 2010) (2 pages).
Korean Intellectual Property Office, International Search Report in International Application No. PCT/US2010/026010 (dated Sep. 28, 2010) (2 pages).
Lund et al., "Geothermal (Ground-Source Heat Pumps—A World Overview," GHC Bulletin, Sep. 2004 (edited and updated version of the article from Renewal Energy World, (Jul.-Aug. 2003), vol. 6 No. 4) (10 pages).
Michael F. Taras, "Reheat Which Concept is Best," ASHRAE Journal: 35-40 (Dec. 2004) (7 pages).
Murphy et al., "Air-Source Integrated Heat Pump for Net-Zero-Energy Houses Technology Status Report," *Oak Ridge National Laboratory*, ORNL-TM-2007-112 (Jul. 2007) (93 pages).
Murphy et al., "Ground-Source Integrated Heat Pump for Net-Zero-Energy Houses Technology Status Report," *Oak Ridge National Laboratory*, ORNL-TM-2007-177 (Dec. 2007) (78 pages).
Third Party Submission dated Nov. 10, 2014 filed in U.S. Appl. No. 13/848,342 (13 Pages).
Tolga N. Aynur, "Variable Refrigerant Flow Systems: A Review, Energy and Buildings," Jan. 2010, pp. 1106-1112, vol. 42 (7 pages).
Wei Yang et al., "The Design Method of U-Bend Geothermal Heat Exchanger of DX-GCHP in Cooling Model," IEEE, 2011, pp. 3635-3637 (English Abstract) (3 pages).
International Search Report and Written Opinion for International Patent Application No. PCT/US2021/020017, mailed May 19, 2021, 7 pages.
International Preliminary Report on Patentability for International Patent Application No. PCT/US2021/020017, mailed Sep. 9, 2022, 7 pages.
Amir Rafati et al., "Fault Detection and Efficiency Assessment for HVAC Systems Using Non-Intrusive Load Monitoring: A Review," Energies 15.1 (2022): 341. (16 pages).
Animesh Pal et al., "Environmental Assessment and Characteristics of Next Generation Refrigerants," Kyushu University Institutional Repository, (2018): 58-66. (10 pages).
J. Navarro-Esbri et al., "A vapour compression chiller fault detection technique based on adaptative algorithms. Application to online refrigerant leakage detection," International Journal of Refrigeration 29.5 (2006): 716-723. (8 pages).
Matthew Wiggins, Ph.D et al., "HVAC Fault Detection," ASHRAE Journal 54.2 (2012): 78-80. (3 pages).
Milan Jain et al., "Beyond control: Enabling smart thermostats for leakage detection," Proceedings of the ACM on Interactive, Mobile, Wearable and Ubiquitous Technologies 3.1 (2019): 1-21. (21 pages).
Rohit Chintala et al., "Automated fault detection of residential air-conditioning systems using thermostat drive cycles," Energy and Buildings 236 (2021): 110691. (28 pages).
Shen Tian, et al., "A study on a real-time leak detection method for pressurized liquid refrigerant pipeline based on pressure and flow rate," Applied Thermal Engineering 95 (2016): 462-470. (17 pages).
Shunsuke Kimura, "Development of a Remote Refrigerant Leakage Detection System for VRFs and Chillers," Purdue University—International Refrigeration and Air Conditioning Conference Paper 2304, 2022. (10 pages).
Xudong Wang et al., "A2L Refrigerants Leaks and Ignitions Testing under Whole Room Scale," Purdue University—International Refrigeration and Air Conditioning Conference Paper 1849, 2018. (11 pages).
Taras, Michael F., "Comparison of Reheat Strategies for Constant Volume Rooftop Units", Carrier Corporation, Mar. 2008, 10p.
Baldini, Luca et al. , "Decentralized cooling and dehumidification with a 3 stage LowEx heat exchanger for free reheating", Elsevier, Energy and Buildings, v76, Jun. 2014, pp. 270-277.
Bobelin, Damien et al., "Experimental Results of a Newly Developed Very High Temperature Industrial Heat Pump (140 C) Equipped With Scroll Compressors and Working With a New Blend Refrigerant", Purdue University, Purdue e-Pubs, International Refrigeration and Air Conditioning Conference, School of Mechanical Engineering, 2012, 11p.
Han, Xing et al., "A novel system of the isothermal dehumidification in a room air-conditioner", Elsevier, Energy and Buildings v 57, 2013, pp. 14-19.
Mayhew, Balwin, "Dehumidification using CHW Return Based Reheat", Decarb Healthcare, A Guidebook for Decarbonizing Healthcare, Sep. 30, 2023, 6p.
Johnson Controls, "Premier 25 Ton to 80 Ton Rooftop Units R-410A Start-Up and Operation Guide", Form No. 5881421-JSG-A-02222, issued Feb. 2, 2022, 170p.

HEAT PUMP AND WATER HEATER

CROSS-REFERENCE TO RELATED APPLICATIONS

This application is a continuation of U.S. Nonprovisional application Ser. No. 17/129,558 filed on Dec. 21, 2020, which is a continuation of U.S. Nonprovisional application Ser. No. 15/634,434 filed on Jun. 27, 2017, which claims the benefit of U.S. Provisional Application No. 62/359,798 filed on Jul. 8, 2016. These applications are incorporated by reference herein in their entirety.

STATEMENT REGARDING FEDERALLY SPONSORED RESEARCH AND DEVELOPMENT

This application is not federally sponsored.

FIELD

The instant disclosure relates generally to heating, ventilation, and air conditioning systems and methods and, more particularly but without limitation, to heat pump systems and control methods.

BACKGROUND

Modern reversible heat pump systems are designed with improved efficiency and reduced energy consumption to comply with the heating, air conditioning, and ventilation industry trends, sustainability initiatives, and governmental regulations to increase efficiency thresholds in both heating and cooling modes of operation. In particular, integration of the water heating option into the heat pump design in commercial and residential applications (in place of electric or gas heaters) is becoming increasingly popular and allows for more efficient energy utilization to reduce an overall building waste heat disposal. However, due to limitations imposed by the system design and operating conditions, the cycle schematics that integrate the water heating option known to date are relatively costly, complex, inflexible in operation, and less reliable. They also employ extra refrigerant charge and often lack desirable control options and features. There exists a need, therefore, to solve these problems.

SUMMARY

A heat pump and water heating system for conditioning a space and heating water is disclosed, comprising: (a) a heat pump refrigerant circuit comprising a refrigerant circuit that fluidly interconnects: (i) a compressor having a discharge outlet and a suction port; (ii) a source heat exchanger; (iii) a space heat exchanger; (iv) an expansion valve positioned between the space heat exchanger and the source heat exchanger; (v) a reversing valve positioned on the discharge side of the compressor and configured to alternately direct refrigerant flow from the discharge outlet of the compressor to the one of the source heat exchanger and the space heat exchanger and to alternately return flow from the other of the source heat exchanger and the space heat exchanger to the suction port of the compressor; (vi) a water heater heat exchanger positioned on the discharge side of the compressor between the compressor and the reversing valve; (vii) a water heating valve on the discharge side of the compressor; (viii) a water heater heat exchanger bypass line connecting the water heating valve and the refrigerant line between the water heater heat exchanger and the reversing valve and configured to alternately direct at least a portion of refrigerant from the discharge outlet of the compressor to one of the bypass line or the water heater heat exchanger; and (b) controls for operating the heat pump and water heating system in response to the space conditioning demands and the water heating demands.

The water heating valve may be a regulating valve and the system controls may operate the regulating valve in response to the water heating demands to adjust the relative amount of refrigerant flow directed through the water heater heat exchanger and the water heater heat exchanger bypass line. The water heating valve may be a rapid cycle valve and the system controls may operate the rapid cycle valve in response to the water heating demands to adjust the relative amount of refrigerant flow directed through the water heater heat exchanger and the water heater heat exchanger bypass line. The water heating valve may be a pulse width modulation valve and the system controls may operate the pulse width modulation modulating valve in response to the water heating demands to adjust the relative amount of refrigerant flow directed through the water heater heat exchanger and the water heater heat exchanger bypass line.

The water heating valve may be a 3-way valve. The water heating valve may be a pair of conventional 2-way valves. The water heating valve may be positioned upstream the water heating heat exchanger with respect to the refrigerant flow. A check valve may be positioned downstream the water heating heat exchanger with respect to refrigerant flow. The water heating valve may be positioned downstream the water heating heat exchanger with respect to refrigerant flow.

The heat pump and water heating system may include a bypass circuit around the source heat exchanger, where the bypass circuit around the source heat exchanger may include a bypass refrigerant line and a bypass valve. The heat pump and water heating system may include a bypass circuit around the space heat exchanger, where the bypass circuit around the space heat exchanger may include a bypass refrigerant line and a bypass valve. The heat pump system may be one of water-to-air, water-to-water, air-to-water, and air-to-air system. The heat pump and water heating system may include air and water circulation devices assisting in heat interaction for space conditioning and water heating, where at least one of the compressor and the water circulating or air circulating devices may be a variable capacity device.

A method is disclosed for operating a heat pump system for conditioning a space and heating water wherein the heat pump system comprises a water heater heat exchanger, a water heater heat exchanger bypass line, and a water heater valve configured to direct refrigerant from the discharge side of the compressor in the heat pump system in selected relative percentages through the water heater heat exchanger and the water heater heat exchanger bypass line. The method includes operating the water heater valve in response to the space conditioning and water heating demands to adjust the selected relative percentages of refrigerant being directed through the water heater heat exchanger and the water heater heat exchanger bypass line.

The selected relative percentages of the refrigerant being directed through the water heater heat exchanger and the water heater heat exchanger bypass line may be in the range from zero percent to one hundred percent. The space conditioning demand may take a priority over water heating demand.

The water heating valve may be a regulating valve, and the method may include operating the regulating valve in response to the water heating demands of the space to adjust the relative amount of refrigerant flow directed through the water heater heat exchanger and the water heater heat exchanger bypass line. The water heating valve may be a rapid cycle valve, and the method may include operating the rapid cycle valve in response to the water heating demands of the space to adjust the relative amount of refrigerant flow directed through the water heater heat exchanger and the water heater heat exchanger bypass line. The water heating valve may be a pulse width modulation valve, and the method may include operating the pulse width modulation valve in response to the water heating demands of the space to adjust the relative amount of refrigerant flow directed through the water heater heat exchanger and the water heater heat exchanger bypass line. The water heating valve may be a 3-way valve. The water heating valve may be a pair of conventional 2-way valves.

The water heating valve may be positioned upstream of the water heating heat exchanger with respect to the refrigerant flow. The check valve may be positioned downstream of the water heating heat exchanger with respect to refrigerant flow. The water heating valve may be positioned downstream of the water heating heat exchanger with respect to refrigerant flow.

The heat pump system may include a bypass circuit around the source heat exchanger and the bypass circuit around the source heat exchanger may include a bypass refrigerant line and a bypass valve. The heat pump system may include a bypass circuit around the space heat exchanger and the bypass circuit around the space heat exchanger may include a bypass refrigerant line and a bypass valve. The heat pump system may be one of water-to-air, water-to-water, air-to-water, and air-to-air system. The heat pump system may include air and water circulation devices assisting in heat interaction for space conditioning and water heating and the at least one of the compressor and the water circulating or air circulating devices may be a variable capacity device.

BRIEF DESCRIPTION OF THE DRAWINGS

The accompanying drawings, which are incorporated into and form a part of the specification, illustrate one or more embodiments and, together with this description, serve to explain the principles of the disclosure. The drawings merely illustrate various embodiments of the disclosure and are not to be construed as limiting the scope of the instant disclosure.

DETAILED DESCRIPTION OF THE PREFERRED EMBODIMENT(S)

The instant disclosure discloses a heat pump and water heater system having a simplified, reliable, flexible and inexpensive design that provides five distinct modes of operation that can be extended to numerous combinations thereof. In at least one embodiment, this is accomplished in principle by the addition of a water heating heat exchanger and a refrigerant bypass line around the water heating heat exchanger. A three-way valve allows the refrigerant flow through the bypass line to be actuated and controlled. The refrigerant circuit configurations in cooling and heating modes of operation for the conditioned space disclosed herein can integrate water heating with the space conditioning or employ water heating independently from the space conditioning. Furthermore, the system design is not susceptible to the refrigerant charge migration common in conventional systems. The system provides an advantage of requiring a lower refrigerant charge amount (which may be critical for the conversion to the low global warming refrigerants), provides enhanced efficiency in all modes of operation, and allows for an extended operational envelope.

Figure 1:
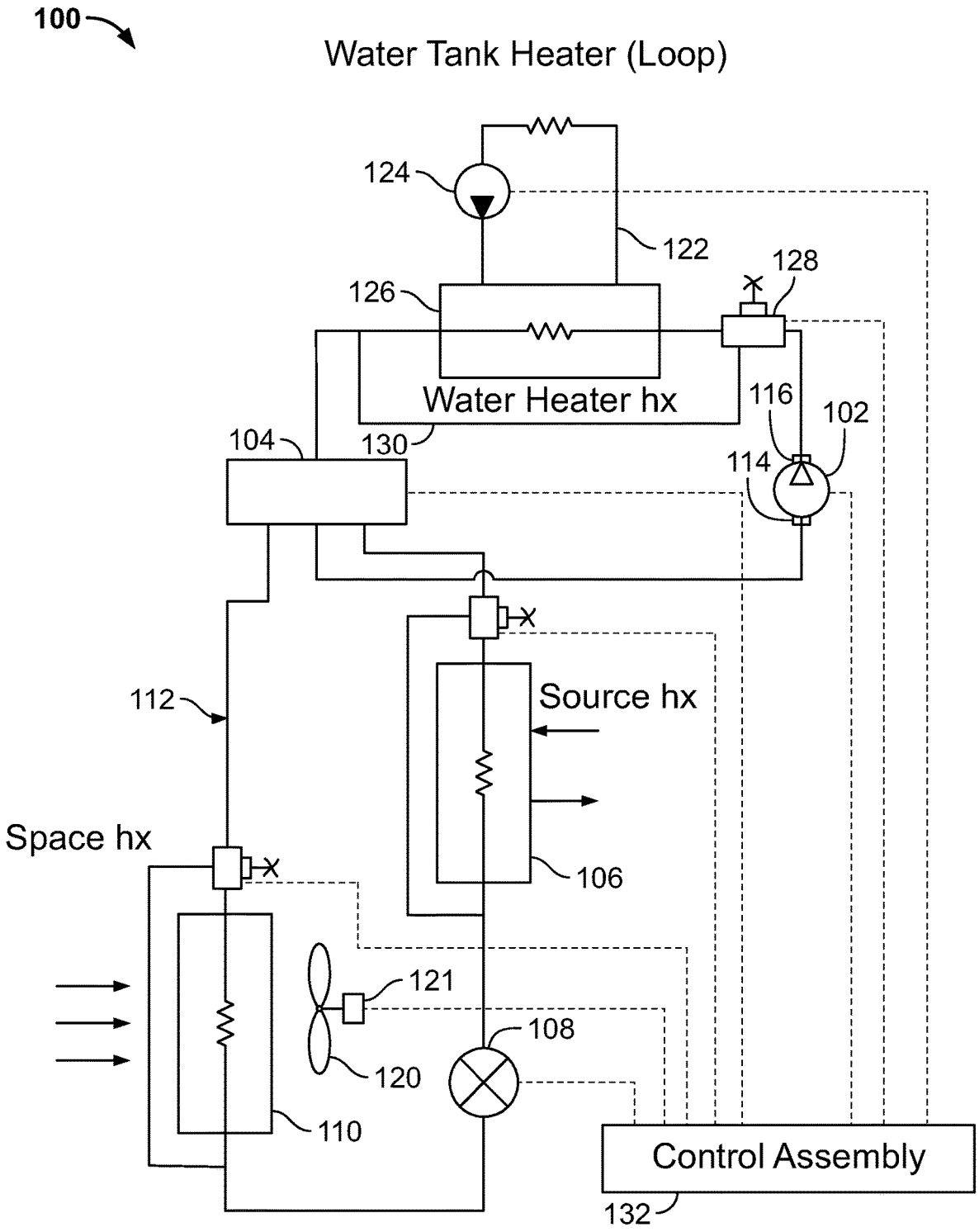
FIG. 1 is a schematic diagram of a heat pump and water heating system constructed in accordance with various embodiments of the instant disclosure.

Referring to FIG. 1, the heat pump system 100 comprises a compressor 102, a four-way reversing valve 104, a source heat exchanger 106, an expansion device 108, and a space heat exchanger 110, all interconnected by refrigerant lines designated collectively at 112. The compressor 102 has a suction inlet port 114 and discharge outlet port 116. The compressor 102 compresses refrigerant from a low pressure $P_1$ to a high pressure $P_2$ and circulates refrigerant throughout the refrigerant circuit.

The compressor 102 may be a variable capacity compressor, such as a variable speed compressor, a compressor with an integral pulse width modulation option, or a compressor incorporating various unloading options. These types of compressors allow for better control of the operating conditions and manage the thermal load on the heat pump system 100.

The source heat exchanger 106 may be a refrigerant-to-water, refrigerant-to-brine, or refrigerant-to-air heat exchanger and is not limited to any particular heat exchanger type or configuration. The associated fan or pump (not shown) may be of a variable flow type, such as being driven by a variable speed motor, a pulse width-modulated motor, or an ON/OFF cycling motor, to enhance operation and control of the heat pump system 100.

The expansion device 108 may be an electronic expansion valve, a mechanical expansion valve, or a fixed-orifice/capillary tube/accurator. The expansion device 108 may have bi-directional design or may be replaced by a pair of unidirectional expansion devices with the associated check valve bypass options to provide refrigerant re-routing when the flow changes direction throughout the refrigerant cycle.

The space heat exchanger 110 may be a refrigerant-to-air, refrigerant-to-water or refrigerant-to-brine heat exchanger and is not limited to any particular heat exchanger type or configuration. In the case of the exemplary air-to-refrigerant heat exchanger shown in the drawings, the associated air management system may be a fan 120 of any known type and may be equipped with a variable flow capability feature, such as being driven by a variable speed motor 121, to enhance operation and control of the heat pump system 100. Alternately, the motor 121 may be a pulse width modulated motor or an ON/OFF cycling motor. Of course, in the case of a water-to-refrigerant or brine-to-refrigerant heat exchanger, the fan 120 and motor 121 are replaced by a pump and a motor that may incorporate similar variable capacity capability.

The heat pump system 100 includes a water tank heater loop 122 for heating water in the structure (not shown). A pump 124 circulates water through the loop 122 and a water heater heat exchanger (WHHX) 126. The pump 124 may have a variable flow capability, such as being driven by a variable speed motor, pulse width modulated motor, or ON/OFF cycling motor, to better control operating conditions for the heat pump system 100 and water temperature within the water tank (not shown). The water heater heat exchanger 126, which is typically a refrigerant-to-water heat exchanger, is connected in-line between the discharge side of the compressor 102 and the 4-way reversing valve 104. The water heater heat exchanger 126 operates as a desuperheater and a condenser when it is engaged within the active refrigerant circuit of the heat pump system 100.

A 3-way valve 128 interposed between the compressor 102 and water heater heat exchanger 126 allows the system control 132 for the heat pump system 100 to command the operation of the loop 122. A bypass line 130 (WHHX bypass) connects the 3-way valve 128 to the outlet side of the water heater heat exchanger 126 to direct at least a portion of refrigerant around the water heater heat exchanger 126 when the water tank heater loop 122 is not actuated. In at least one embodiment, the 3-way valve 128 is a modulating type and can be controlled by a stepper motor (not shown) permitting the system control 132 for the heat pump system 100 modulate the percentage of the refrigerant flow directed through the bypass line 130 thus allowing for a better control of operating conditions for the heat pump system 100 and improved operation of the water heater heat exchanger 126.

Alternately, the 3-way valve 128 may be replaced by a pair of conventional valves, such as a pair of rapid cycle solenoid valves, or by a rapid cycle three-way valve. Furthermore, to prevent refrigerant migration while switching between different modes of operation, a check valve (not shown) may be positioned downstream the water heater heat exchanger 126 with respect to the refrigerant flow. Additionally, the 3-way valve 128 may be positioned at the exit of the water heater heat exchanger 126 with respect to the refrigerant flow.

The heat pump system 100 has five distinct modes of operation that are primarily controlled by the 4-way valve 104 and the 3-way valve 128, while augmented by the multiple variable capacity devices, such as compressors, fans and pumps, integrated into the system. These modes of operation are space cooling only, space cooling and water heating, space heating only, space heating and water heating, and water heating only. Additionally, the heat pump system 100 may adjust operation in any of the modes depicted above and exactly match the space conditioning and water heating requirements without excessive ON/OFF cycling that negatively impacts system reliability and fluctuations in operating conditions.

Figure 2:
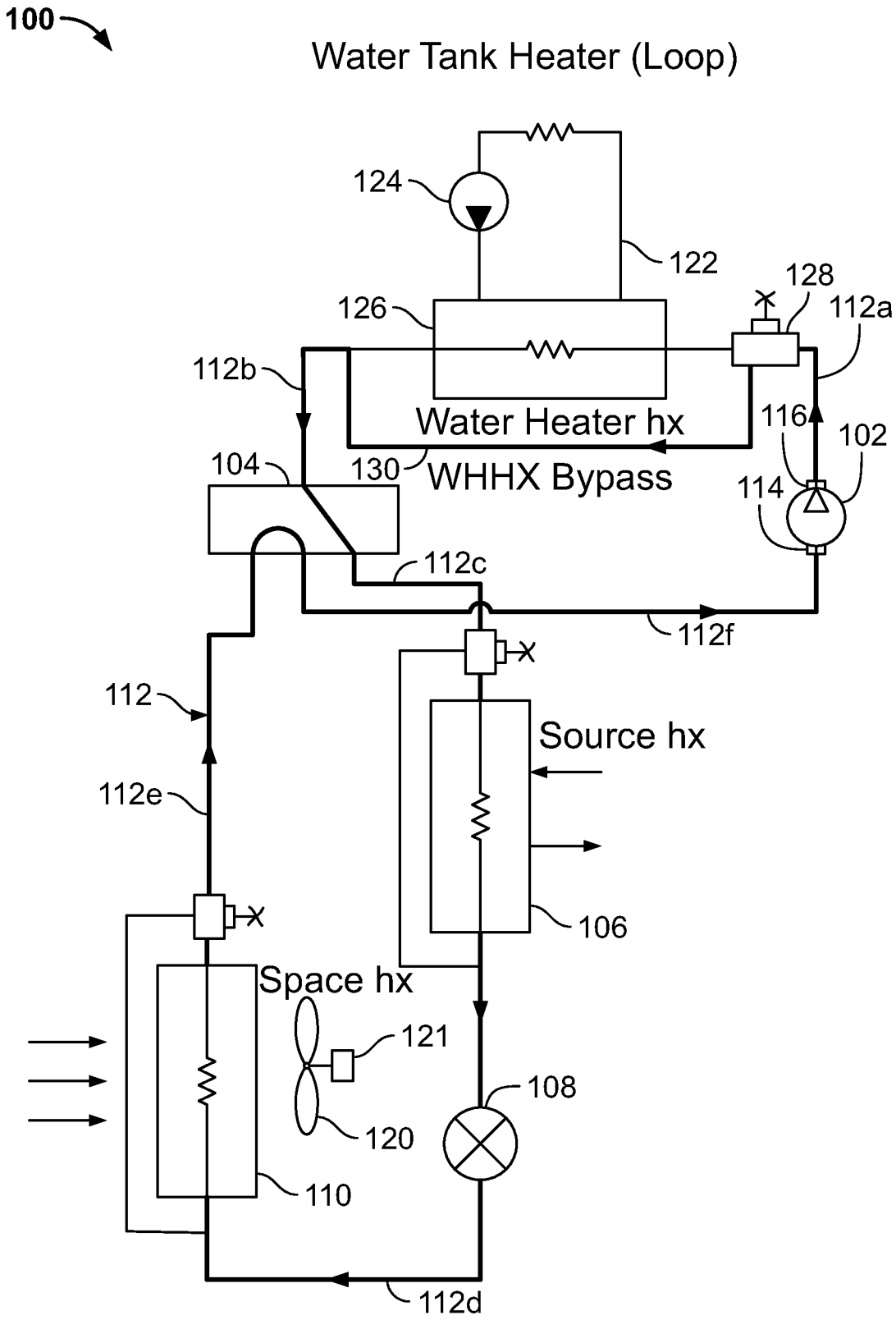
FIG. 2 is a schematic diagram of the heat pump and water heating circuit of FIG. 1 shown operating in a space cooling mode. The system controls are omitted to simplify the illustration.

In the space cooling mode of operation depicted in FIG. 2, the refrigerant is compressed in the compressor 102 and discharged from the compressor discharge port 116 into the discharge refrigerant line 112*a* connecting the compressor 102 to the 3-way valve 128. In the cooling mode of operation, the 3-way valve 128 directs the refrigerant flow through the bypass line 130 around the water heater heat exchanger 126 and through refrigerant line 112*b* connecting the 3-way valve 128 and the 4-way valve 104.

The 4-way valve 104 is configured to connect the refrigerant to the source heat exchanger 106 through the refrigerant line 112*c*. In this mode, the source heat exchanger 106 is operating as a condenser to desuperheat, condense, and subcool the refrigerant and rejects heat from the refrigerant system to the environment (not shown).

Downstream the source heat exchanger 106, the refrigerant flows through the expansion device 108, where it is expanded from a high pressure to a lower pressure and its temperature is reduced. The refrigerant is then directed to the refrigerant line 112*d* and the space heat exchanger 110 that is acting as an evaporator and superheater in the cooling mode of operation, while removing heat and reducing humidity in the conditioned space (not shown). Downstream of the space heat exchanger 110, refrigerant line 112*e* connects the space heat exchanger 110 to the 4-way valve 104, which is configured to direct the refrigerant to the suction port 114 of the compressor 102 through the refrigerant line 112*f* to complete the refrigerant circuit.

Figure 3:
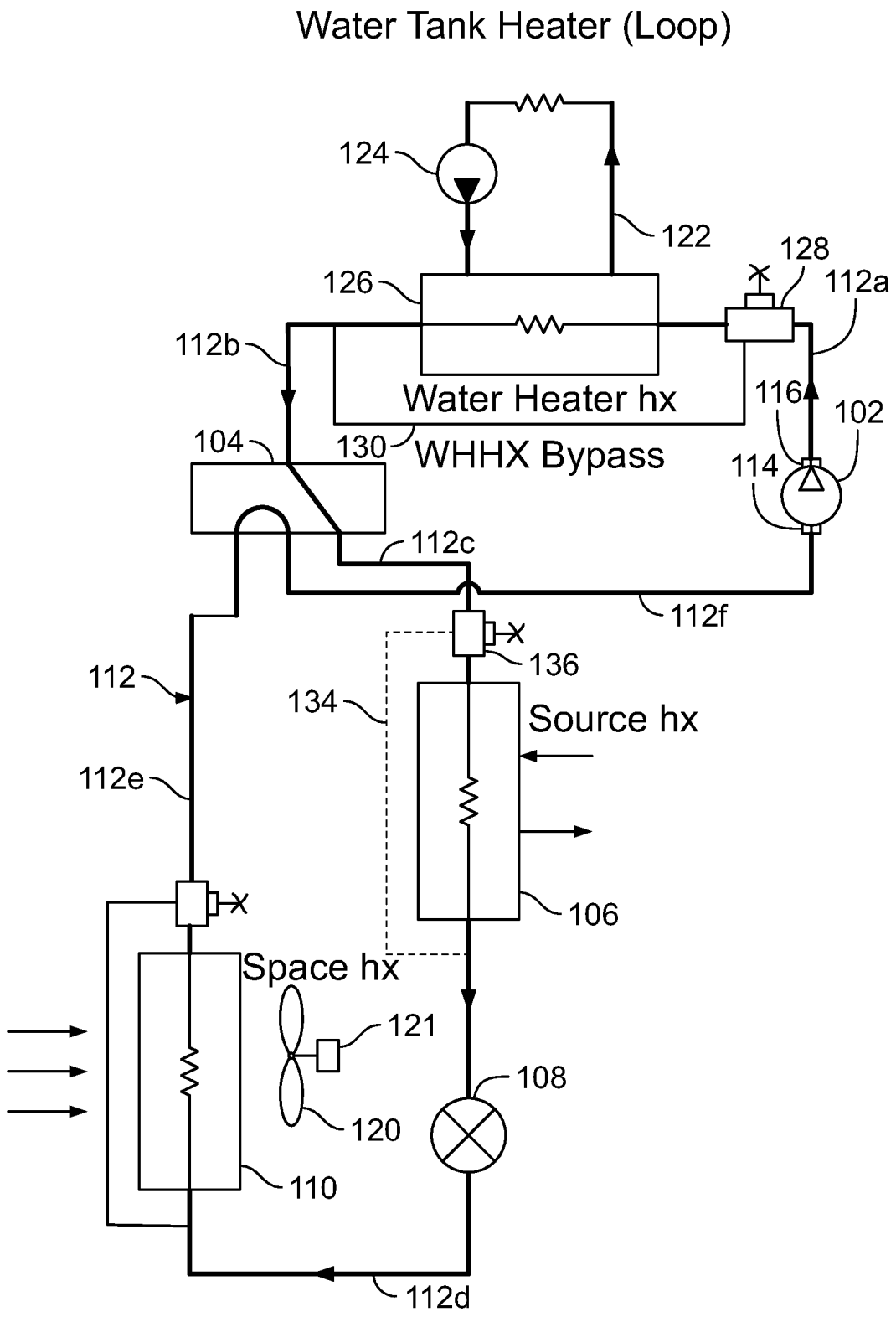
FIG. 3 is a schematic diagram of the heat pump and water heating circuit of FIG. 1 shown operating in a space cooling and water heating mode.
Figure 7:
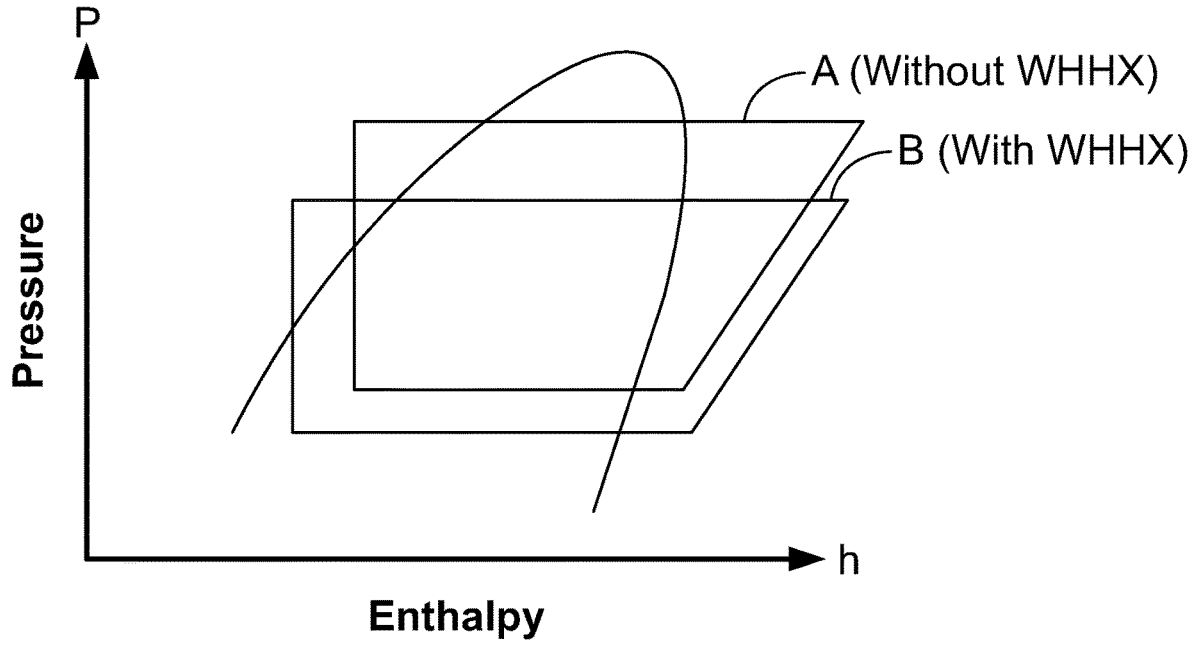
FIG. 7 shows the refrigerant cycles of the system of the present invention graphed onto a P-h (pressure-enthalpy) chart. The cycle designated as "A" illustrates the refrigerant cycle operating without the water heater heat exchanger (WHHX) and the cycle designated as "B" illustrates the refrigerant cycle operating with the water heater heat exchanger.

In the space cooling and water heating mode of operation depicted in FIG. 3, the 3-way valve 128 is configured to direct at least a portion of refrigerant through the water heater heat exchanger 126, instead of the bypass refrigerant line 130. In this mode of operation, the water heating heat exchanger 126 may operate as a desuperheater and partial condenser or, alternately, as a desuperheater, condenser, and subcooler. In the former case, the source heat exchanger 106 is used to complete the condensation process and subcool the refrigerant. In the latter case, the source heat exchanger 106 is used to further subcool the refrigerant and improve operational efficiency and dehumidification capability of the heat pump system 100 (see FIG. 7). Alternatively, in the latter case, the source heat exchanger 106 may be bypassed through a bypass line 134 using a 3-way valve 136 (as shown in broken lines) and the water supply for the source heat exchanger 106 may be shut down to reduce input power for the circulating pump (not shown). The 3-way valve 136 may have a variable capability feature and may be utilized as an auxiliary performance control and pressure control device. In all other aspects, this mode of operation is similar to the cooling mode of operation of FIG. 2.

It will be understood that, if the 3-way valve 128 has regulating (modulating) capability, the refrigerant flow between the bypass refrigerant line 130 and the water heating heat exchanger 126 can be adjusted in any proportion from zero to one hundred percent (0%-100%), precisely satisfying the water heating demand typically defined and measured by the temperature transducer integrated into the water tank, reducing a number of ON/OFF cycles, and thus improving system efficiency and reliability. Such flexibility of the 3-way modulating valve 128 may be combined with other variable capacity devices of the heat pump system 100 described above.

Figure 4:
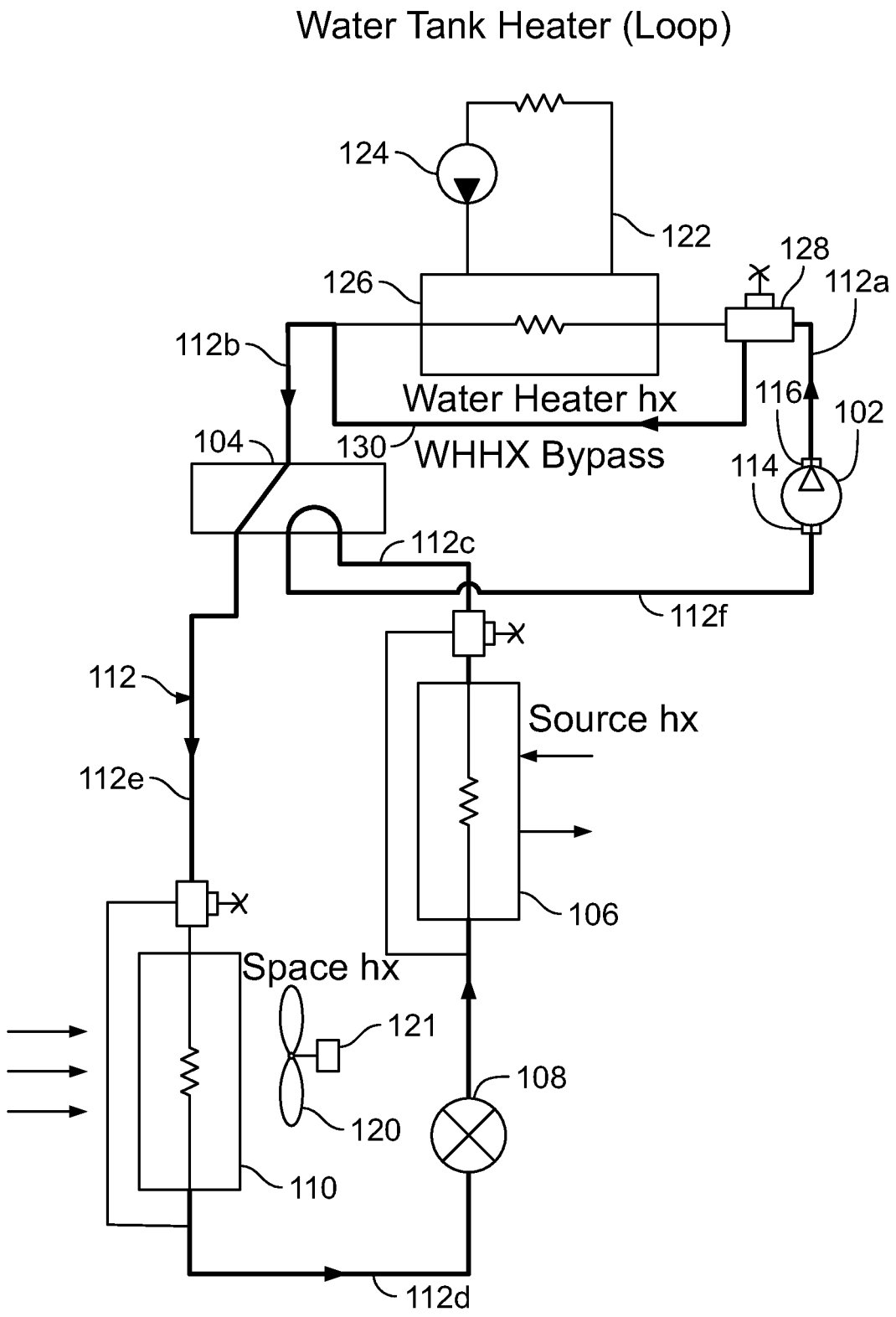
FIG. 4 is a schematic diagram of the heat pump and water heating circuit of FIG. 1 shown operating in a space heating mode.

In the space heating mode of operation depicted in FIG. 4, the refrigerant is compressed in the compressor 102 and discharged from the compressor discharge port 116 into the discharge refrigerant line 112*a* connecting the compressor 102 to the 3-way valve 128. In the heating mode of operation, the 3-way valve 128 directs the refrigerant flow through the bypass line 130 around the water heater heat exchanger 126 and through refrigerant line 112*b* connecting the 3-way valve 128 and the 4-way valve 104. The 4-way valve 104 is configured to direct the refrigerant through the refrigerant line 112*e* to the space heat exchanger 110, which in this mode operates as a condenser to desuperheat, condense, and subcool the refrigerant while heating the conditioned space (not shown). Downstream of the space heat exchanger 110, the refrigerant is directed through the refrigerant line 112*d* to the expansion device 108 where it is expanded from a high pressure to a lower pressure while its temperature is reduced. The refrigerant is then passed through the source heat exchanger 106 acting as an evaporator and superheater, in the heating mode of operation. Downstream of the source heat exchanger 106, the 4-way valve 104 is configured to direct the refrigerant through the refrigerant line 112*f* to the suction port 114 of the compressor 102 to complete the refrigerant cycle.

Figure 5:
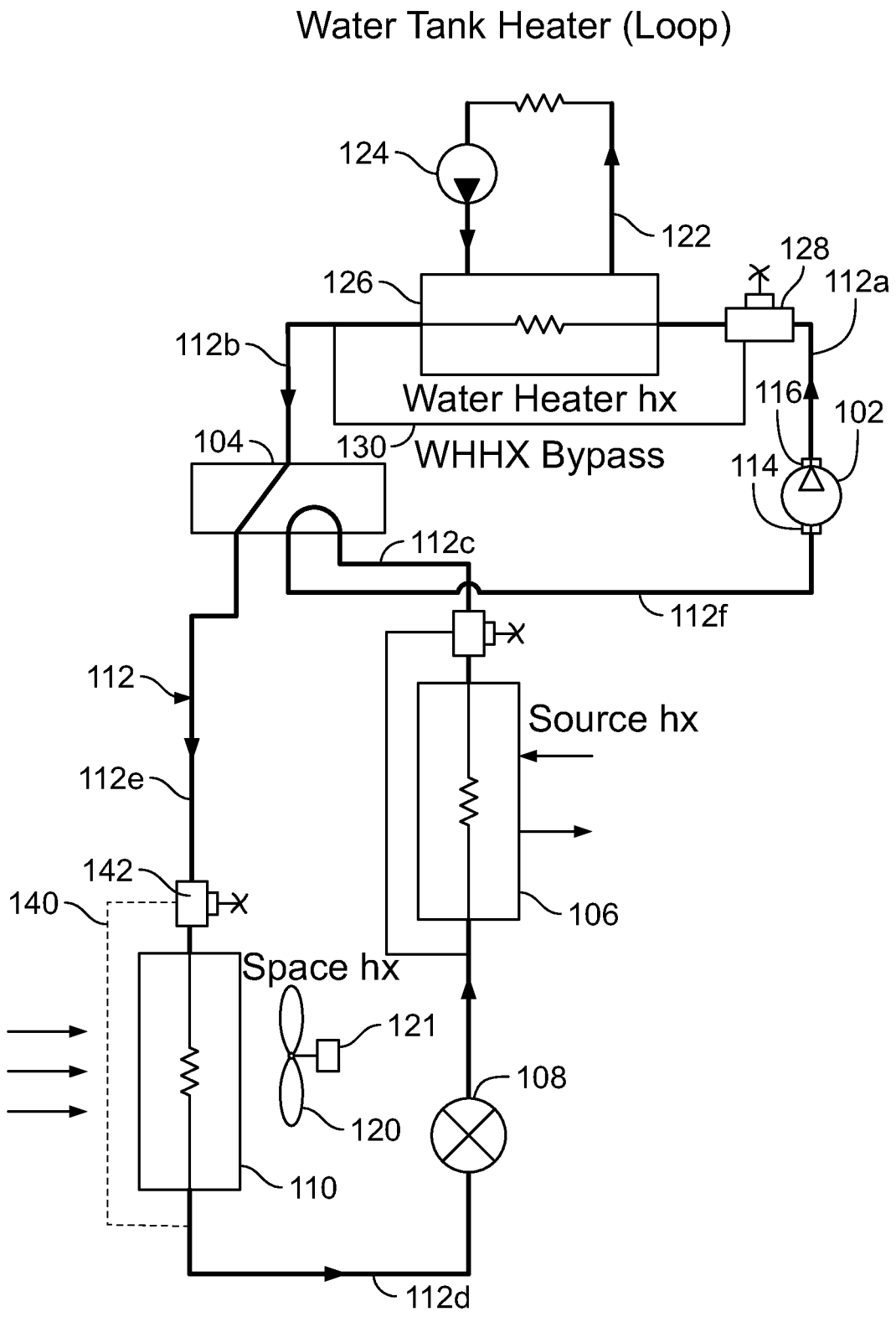
FIG. 5 is a schematic diagram of the heat pump and water heating circuit of FIG. 1 shown operating in a space heating and water heating mode.

In the space heating and water heating mode of operation depicted in FIG. 5, the 3-way valve 128 is configured to direct at least a portion of refrigerant through the water heater heat exchanger 126, instead of the bypass refrigerant line 130. In this mode of operation, the water heating heat exchanger 126 may operate as a desuperheater and partial condenser or, alternately, as a desuperheater, condenser, and subcooler. In the former case, the space heat exchanger 110 may be used to complete the condensation process and subcool the refrigerant. In the latter case, the space heat exchanger 110 may be used to further subcool the refrigerant to improve operational efficiency of the heat pump system 100 (see FIG. 7). Alternatively, in the latter case, at least a portion of refrigerant flow may bypass the space heat exchanger 110 through bypass line 140 using a 3-way valve 142 (as shown in broken lines in FIG. 6) and the airflow for the source heat exchanger 106 may be adjusted to reduce input power for the for the circulating fan (not shown). The 3-way valve 142 may have a variable capability feature and may be utilized as an auxiliary performance control and pressure control device. In all other aspects, this mode of operation is similar to the heating mode of operation depicted in FIG. 4.

It will be understood that the space heating requirements take the priority over the water heating and that water heating may be supplemented, if required, with a gas or electric heater (not shown). Furthermore, if the 3-way valve 128 has regulating (modulating) capability, the refrigerant flow between the bypass refrigerant line 130 and the water heating heat exchanger 126 can be adjusted in any proportion from zero to one hundred percent (0%-100%) precisely satisfying the water heating demand typically defined and measured by the temperature transducer integrated into the water tank, reducing a number of ON/OFF cycles, and thus improving system efficiency and reliability. Such flexibility of the 3-way modulating valve 128 may be combined with other variable capacity devices of the heat pump system 100 described above.

Figure 6:
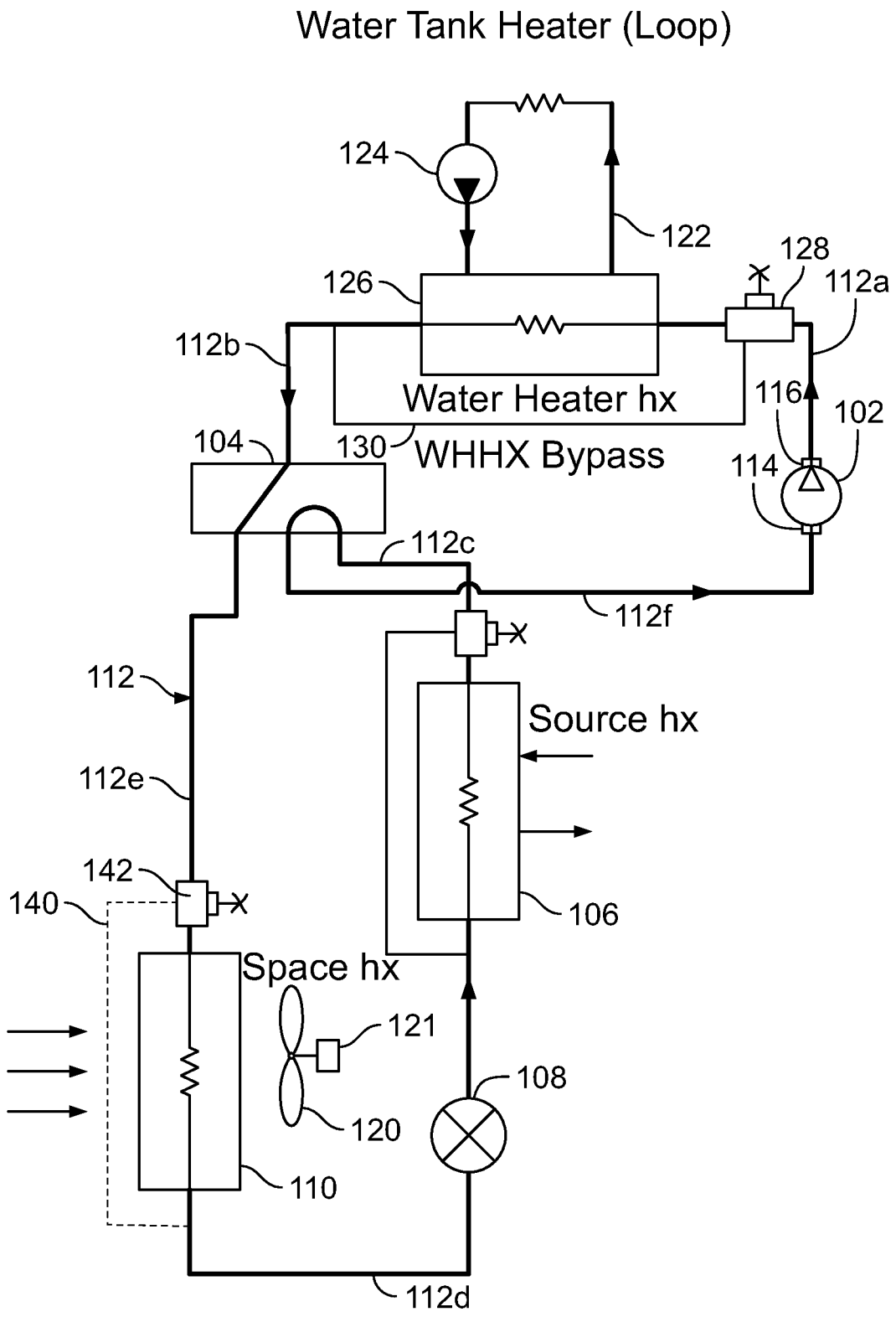
FIG. 6 is a schematic diagram of the heat pump and water heating circuit of FIG. 1 shown operating in a water heating mode.

In the water heating only mode of operation depicted in FIG. 6, the 3-way valve 128 is configured to direct the refrigerant through the water heater heat exchanger 126, instead of the bypass refrigerant line 130. In this mode of operation, the water heating heat exchanger 126 operates as a desuperheater, condenser, and subcooler. In this mode of operation, the airflow or water flow through the space heat exchanger 110 is deactivated. Alternatively, the space heat exchanger 110 may be bypassed through the bypass line 140 using the 3-way valve 142 to reduce the refrigerant side parasitic pressure drop. In all other aspects, this mode of operation is similar to the space heating and water heating mode of operation shown in FIG. 5.

Returning now to FIG. 1, the heat pump system 100 includes the controls 132 operatively connected to the electronic expansion device 108, the fan motor 121 controlling the speed and operation of the fan 120, the 4-way reversing valve 104, the variable speed compressor 102, the three-way valve 128, and the pump motor controlling the speed and operation of the pump 124 in the water heater loop 122. The system controls 132 for the heat pump system 100 will also include various sensors (not shown), such as temperature sensors to report the air temperature in the space, the water temperature of the water in the water tank loop, and temperatures, pressures, flow rates and speed of the various components driven by electric motors, throughout the heat pump system 100.

The control logic will be programmed to selectively operate the water heater heat exchanger loop or/and to at least partially bypass it using the three-way valve 128. The control logic preferably is set up to allow for the space conditioning as the higher priority over water heating. The refrigerant head pressure control, to ensure safe and reliable operation of the system components such as the 4-way reversing valve 104 and compressor 102, can be accomplished by adjusting the compressor speed, fan speed, pump speed, and the amount of refrigerant flowing through the water heater heat exchanger bypass refrigerant lines 130, 134 and 140.

The selective utilization of the water heating heat exchanger 126, in combination with the space heat exchanger 110 or the source heat exchanger 106 and air/water moving devices, such as the fan 120 and the water heater heat exchanger loop pump 124, respectively in the heating and cooling mode of operation, allows for the system performance (capacity and efficiency) optimization and dehumidification capability improvement.

As described above, the heat pump system 100 of the present disclosure offers many advantages and benefits. By way of example, as depicted above and illustrated in the P-h diagram of FIG. 7, when the water heater heat exchanger is included in the active operating circuit of the heat pump system 100, the system efficiency is enhanced, compressor power is reduced, and dehumidification capability is improved. The system provides augmented performance and control as well as offers reduced cost, improved operational flexibility, and enhanced reliability.

The embodiments shown and described above are exemplary. Many details are often found in the art and, therefore, many such details are neither shown nor described herein. It is not claimed that all of the details, parts, elements, or steps described and shown were invented herein. Even though numerous characteristics and advantages of the present disclosure have been described in the drawings and accompanying text, the description is illustrative only. Changes may be made in the details, especially in matters of shape, size, and arrangement of the parts within the principles of the instant disclosure to the full extent indicated by the broad meaning of the terms of the attached claims. The description and drawings of the specific embodiments herein do not point out what an infringement of this patent would be, but rather provide an example of how to use and make the invention as defined by the appended claims. Likewise, the abstract is neither intended to define the invention, which is measured by the appended claims, nor is it intended to be limiting as to the scope of the instant disclosure in any way.

Rather, the limits of the invention and the bounds of patent protection are measured by and defined in the following claims.

What is claimed is:

1. A heat pump system for conditioning air in a space, comprising:

a compressor configured to circulate a refrigerant through a refrigerant circuit, the compressor having a discharge outlet port and an inlet suction port;

a liquid source heat exchanger configured to exchange heat between the refrigerant and a heat exchange liquid;

a space heat exchanger configured to exchange heat between the refrigerant and the air, the air conditioned thereby for use in the space;

a bi-directional expansion valve disposed on the refrigerant circuit and positioned between the liquid source heat exchanger and the space heat exchanger;

a desuperheater heat exchanger configured to exchange heat between the refrigerant and water to heat the water;

a 3-way valve disposed along the refrigerant circuit between the compressor, the desuperheater heat exchanger, and a desuperheater bypass circuit, wherein the 3-way valve is configured to selectively direct the refrigerant from the compressor to either the desuperheater heat exchanger or to the desuperheater bypass circuit;

a reversing valve disposed along the refrigerant circuit, the reversing valve including a first port configured to receive the refrigerant from the desuperheater bypass circuit and/or from the desuperheater heat exchanger, a second port connected to the inlet suction port of the compressor, a third port connected to the space heat exchanger, and a fourth port connected to the liquid source heat exchanger, wherein in a first operating mode the reversing valve is configured to convey the refrigerant from the first port to the fourth port and from the third port to the second port to direct the refrigerant to the liquid source heat exchanger configured to operate as a condenser, through the bi-directional expansion valve, and to the space heat exchanger configured to operate as an evaporator, and wherein in a second operating mode the reversing valve is configured to convey the refrigerant from the first port to the third port and from the fourth port to the second port to direct the refrigerant to the space heat exchanger configured to operate as a condenser, through the bi-directional expansion valve, and to the liquid source heat exchanger configured to operate as an evaporator.

2. The heat pump system of claim 1, including a fan driven by a motor, the fan configured to flow the air over a portion of the space heat exchanger.

3. The heat pump system of claim 1, wherein the bi-directional expansion valve is a fixed orifice valve, a mechanical valve, or an electronic valve.

4. The heat pump system of claim 1, wherein the desuperheater heat exchanger is a refrigerant-to-liquid heat exchanger configured to exchange heat between the refrigerant in the refrigerant circuit and the water in a water storage loop.

5. The heat pump system of claim 4, including a water pump for circulating the heated water in the water storage loop and through the desuperheater heat exchanger.

6. The heat pump system of claim 1, including a pump disposed on a source loop for circulating the heat exchange liquid through the liquid source heat exchanger.

7. The heat pump system of claim 1, including a controller configured to control operation of the compressor, the reversing valve, the 3-way valve, the bi-directional expansion valve, a first pump for circulating the water through the desuperheater heat exchanger, and a second pump for circulating the heat exchange liquid through the liquid source heat exchanger.

8. The heat pump system of claim 1, wherein the reversing valve and the 3-way valve are configured to alter a flow of the refrigerant to change a mode of operation between the first operating mode defining a space cooling mode, a space cooling and water heating mode, the second operating mode defining a space heating mode, a space heating and water heating mode, and a primary water heating mode.

9. The heat pump system of claim 8, including a second 3-way valve connected to a source heat exchanger bypass circuit to permit the refrigerant to bypass the liquid source heat exchanger in the space cooling and water heating mode.

10. The heat pump system of claim 9, including a third 3-way valve connected to a space heat exchanger bypass circuit to permit the refrigerant to bypass the space heat exchanger in the space heating and water heating mode and in the water heating mode.

11. The heat pump system of claim 10, wherein to operate in the space heating and water heating mode, the 3-way valve is configured to direct the refrigerant from the compressor to the desuperheater heat exchanger, the reversing valve is configured to receive, via the first port, the refrigerant from the desuperheater heat exchanger and direct, via the third port, the refrigerant to the third 3-way valve, the third 3-way valve is configured to direct a fifth portion of the refrigerant to the space heat exchanger and a sixth remainder portion of the refrigerant to the space heat exchanger bypass circuit, the bi-directional expansion valve is configured to receive the fifth portion of the refrigerant from the space heat exchanger and the sixth remainder portion of the refrigerant from the space heat exchanger bypass circuit, the liquid source heat exchanger is configured to operate as an evaporator and receive all of the refrigerant from the bi-directional expansion valve, the reversing valve is configured to receive, via the fourth port, the refrigerant from the liquid source heat exchanger and direct, via the second port, the refrigerant to the compressor.

12. The heat pump system of claim 10, wherein to operate in the space heating and water heating mode, the 3-way valve is configured to direct a seventh portion of the refrigerant from the compressor to the desuperheater heat exchanger and an eighth remainder portion of the refrigerant from the compressor to the desuperheater bypass circuit, the reversing valve is configured to receive, via the first port, the seventh portion and the eighth remainder portion of the refrigerant from the desuperheater heat exchanger and the desuperheater bypass circuit, respectively, and direct, via the third port, all of the refrigerant to the third 3-way valve, the third 3-way valve is configured to direct a fifth portion of the refrigerant to the space heat exchanger and a sixth remainder portion of the refrigerant to the space heat exchanger bypass circuit, the bi-directional expansion valve is configured to receive the fifth portion of the refrigerant from the space heat exchanger and the sixth remainder portion of the refrigerant from the space heat exchanger bypass circuit, the liquid source heat exchanger is configured to operate as an evaporator and receive all of the refrigerant from the bi-directional expansion valve, the reversing valve is configured to receive, via the fourth port, the refrigerant from the liquid source heat exchanger and direct, via the second port, the refrigerant to the compressor.

13. The heat pump system of claim 9, wherein to operate in the space cooling and water heating mode, the 3-way valve is configured to direct the refrigerant from the compressor to the desuperheater heat exchanger configured to subcool the refrigerant, the reversing valve is configured to receive, via the first port, the refrigerant from the desuperheater heat exchanger and direct, via the fourth port, the refrigerant to the second 3-way valve, the second 3-way valve is configured to direct the refrigerant to the source heat exchanger bypass circuit, the bi-directional expansion valve is configured to receive the refrigerant from the source heat exchanger bypass circuit, the space heat exchanger is configured to operate as an evaporator and receive the refrigerant from the bi-directional expansion valve, and the reversing valve is configured to receive, via the third port, the refrigerant from the space heat exchanger and direct, via the second port, the refrigerant to the compressor.

14. The heat pump system of claim 9, wherein to operate in the space cooling and water heating mode, the 3-way valve is configured to direct a first portion of the refrigerant from the compressor to the desuperheater heat exchanger and a second remainder portion of the refrigerant from the compressor to the desuperheater bypass circuit, the reversing valve is configured to receive, via the first port, the first portion and the second remainder portion of the refrigerant from the desuperheater heat exchanger and the desuperheater bypass circuit, respectively, and direct, via the fourth port, all of the refrigerant to the second 3-way valve, the second 3-way valve is configured to direct a third portion of the refrigerant to the liquid source heat exchanger and a fourth remainder portion of the refrigerant to the source heat exchanger bypass circuit, the bi-directional expansion valve is configured to receive the third portion of the refrigerant from the liquid source heat exchanger and the fourth remainder portion of the refrigerant from the source heat exchanger bypass circuit, the space heat exchanger is configured to operate as an evaporator and receive all of the refrigerant from the bi-directional expansion valve, and the reversing valve is configured to receive, via the third port, the refrigerant from the space heat exchanger and direct, via the second port, the refrigerant to the compressor.

15. The heat pump system of claim 8, wherein to operate in the space cooling mode, the 3-way valve is configured to direct the refrigerant from the compressor to the reversing valve via the desuperheater bypass circuit;

the reversing valve is configured to direct the refrigerant, via the first port and the fourth port, to the liquid source heat exchanger that is configured to operate as a condenser, the bi-directional expansion valve is configured to receive the refrigerant from the liquid source heat exchanger, the space heat exchanger is configured as an evaporator and receive the refrigerant from the bi-directional expansion valve, and the reversing valve is configured to receive, via the third port, the refrigerant from the space heat exchanger and direct, via the second port, the refrigerant to the compressor.

16. The heat pump system of claim 8, wherein to operate in the space cooling and water heating mode, the 3-way valve is configured to direct the refrigerant from the compressor to the desuperheater heat exchanger, the reversing valve is configured to receive, via the first port, the refrigerant from the desuperheater heat exchanger and direct, via the fourth port, the refrigerant to the liquid source heat exchanger that is configured to operate as a condenser, the bi-directional expansion valve is configured to receive the refrigerant from the liquid source heat exchanger, the space heat exchanger is configured to operate as an evaporator and receive the refrigerant from the bi-directional expansion valve, and the reversing valve is configured to receive, via the third port, the refrigerant from the space heat exchanger and direct, via the second port, the refrigerant to the compressor.

17. The heat pump system of claim 8, wherein to operate in the space heating mode, the 3-way valve is configured to direct the refrigerant from the compressor to the reversing valve via the desuperheater bypass circuit;

the reversing valve is configured to direct the refrigerant, via the first port and the third port, to the space heat exchanger that is configured to operate as a condenser, the bi-directional expansion valve is configured to receive the refrigerant from the space heat exchanger, the liquid source heat exchanger is configured to operate as an evaporator and receive the refrigerant from the bi-directional expansion valve, and the reversing valve is configured to receive, via the fourth port, the refrigerant from the liquid source heat exchanger and direct, via the second port, the refrigerant to the compressor.

18. The heat pump system of claim 8, wherein to operate in the space heating and water heating mode, the 3-way valve is configured to direct the refrigerant from the compressor to the desuperheater heat exchanger, the reversing valve is configured to receive, via the first port, the refrigerant from the desuperheater heat exchanger and direct, via the third port, the refrigerant to the space heat exchanger that is configured to operate as a condenser, the bi-directional expansion valve is configured to receive the refrigerant from the space heat exchanger, the liquid source heat exchanger is configured to operate as an evaporator and receive the refrigerant from the bi-directional expansion valve, the reversing valve is configured to receive, via the fourth port, the refrigerant from the liquid source heat exchanger and direct, via the second port, the refrigerant to the compressor.

19. The heat pump system of claim 8, wherein to operate in the primary water heating mode, the 3-way valve is configured to direct the refrigerant from the compressor to the desuperheater heat exchanger that is configured to operate as a desuperheater, condenser, and subcooler, the reversing valve is configured to receive, via the first port, the refrigerant from the desuperheater heat exchanger and direct, via the third port, the refrigerant toward the space heat exchanger, the bi-directional expansion valve is configured to subsequently receive the refrigerant, the liquid source heat exchanger is configured to operate as an evaporator and receive the refrigerant from the bi-directional expansion valve, and the reversing valve is configured to receive, via the fourth port, the refrigerant from the liquid source heat exchanger and direct, via the second port, the refrigerant to the compressor.

* * * * *